US012193551B1

(12) United States Patent
Castaneda

(10) Patent No.: US 12,193,551 B1
(45) Date of Patent: Jan. 14, 2025

(54) HAIR DRYING DEVICE WITH IMPROVED EFFICIENCY AND IMPROVED SECURITY

(71) Applicant: Keira Valerie Castaneda, Clyde Hill, WA (US)

(72) Inventor: Keira Valerie Castaneda, Clyde Hill, WA (US)

( * ) Notice: Subject to any disclaimer, the term of this patent is extended or adjusted under 35 U.S.C. 154(b) by 0 days.

(21) Appl. No.: 18/774,392

(22) Filed: Jul. 16, 2024

(51) Int. Cl.
*A45D 20/12* (2006.01)

(52) U.S. Cl.
CPC ..... *A45D 20/12* (2013.01); *A45D 2200/15* (2013.01)

(58) Field of Classification Search
CPC ..... A45D 20/12; A45D 2200/15
USPC ..... 34/95–100
See application file for complete search history.

(56) References Cited

U.S. PATENT DOCUMENTS 2,138,240 A * 11/1938 Kobusch ..... F26B 11/0459 366/147
3,797,475 A * 3/1974 Hughes ..... A45D 20/06 392/383
4,198,558 A * 4/1980 Benty ..... A45D 20/30 132/212
5,839,204 A * 11/1998 Cinque ..... A45D 20/10 D28/16
6,199,295 B1 * 3/2001 Smal ..... A45D 20/122 34/98
6,928,235 B2 * 8/2005 Pollack ..... A47K 10/48 392/382
7,946,056 B2 * 5/2011 Kroll ..... A45D 20/22 34/100
8,890,035 B2 * 11/2014 Scheunert ..... A45D 20/12 219/222
9,241,556 B2 * 1/2016 Lee ..... A45D 20/08
11,064,783 B2 * 7/2021 Nelson ..... H01M 10/486
11,641,918 B2 * 5/2023 Jeong ..... A45D 20/12 34/97
11,844,408 B2 * 12/2023 Kim ..... A45D 20/26
2012/0125909 A1 5/2012 Scheunert et al.
2023/0397705 A1 * 12/2023 Carlyle ..... A45D 20/12

FOREIGN PATENT DOCUMENTS

CN 118354699 A * 7/2024 ..... A45D 1/28
EP 2255692 A1 * 12/2010 ..... A45D 20/12
GB 2600472 A * 5/2022 ..... A45D 20/10
KR 20240132191 A * 9/2024
WO WO-2022090684 A1 * 5/2022 ..... A45D 20/10

* cited by examiner

*Primary Examiner* — Stephen M Gravini
(74) *Attorney, Agent, or Firm* — NIXON PEABODY LLP

(57) ABSTRACT

A hair drying device with improved efficiency and improved security is disclosed. The hair drying device has inlet openings draw airflows from outside, outlet openings discharge heated airflows, a wind detector and a power generation block operable to perform protection.

20 Claims, 6 Drawing Sheets

HAIR DRYING DEVICE WITH IMPROVED EFFICIENCY AND IMPROVED SECURITY

BACKGROUND

Hair drying devices are widely used in hair-dressing environments and house appliance fields. Conventional hair drying devices increase the power of the fan and the power of the heating elements, to increase the velocity the heated air flow, to quickly dry the hair. However, the power consumption increases and the security decreases as the power increases. For example, safety accidents such as hair strands twisted into the inlet openings happen occasionally.

Thus, an approach at least addressing the above-mentioned issue is desired.

SUMMARY OF THE INVENTION

In accordance with an embodiment of the present invention, a hair drying device is discussed. The hair drying device comprises: a left inlet opening, a right inlet opening, an internal inlet channel, an air supply inlet, a back inlet opening, a heat block, an outlet opening, a wind detector, and a power generation block. The left inlet opening, the right inlet opening, the internal inlet channel, the air supply inlet, and the back inlet opening are configured to draw airflows into an internal space of the hair drying device. The heat block is configured to heat the airflows. The outlet opening is configured to discharge the airflows heated by the heat block. The wind detector is configured to detect a wind force of the airflows, and to initiate a protect signal if the wind force of the airflows is lower than a force reference. The power generation block is configured to detect a temperature difference between the airflows internal and external of the hair drying device, and to shut down the hair drying device if the temperature difference is higher than a temperature reference.

In addition, in accordance with an embodiment of the present invention, a hair drying device is discussed. The hair drying device comprises: a left inlet opening, a right inlet opening, an internal inlet channel, an air supply inlet, a back inlet opening, an outlet opening, and a wind detector. Airflows are drawn into an internal space of the hair drying device through the left inlet opening, the right inlet opening, the internal inlet channel, the air supply inlet and the back inlet opening. The outlet opening is configured to discharge the airflows. The wind detector is configured to detect a wind force of the airflows and to initiate a protect signal if the wind force of the airflow is lower than a force reference.

Furthermore, in accordance with an embodiment of the present invention, a hair drying device is discussed. The hair drying device comprises: a left inlet opening, a right inlet opening, an internal inlet channel, an air supply inlet, a back inlet opening, a heat block, an outlet opening, and a power generation block. The left inlet opening, the right inlet opening, the internal inlet channel, the air supply inlet, and the back inlet opening are configured to draw airflows into an internal space of the hair drying device. The heat block is configured to heat the airflows. The outlet opening is configured to discharge the airflows heated by the heat block. The power generation block is configured to detect a temperature difference between the airflows internal and external of the hair drying device, and to shut down the hair drying device if the temperature difference is higher than a temperature reference.

BRIEF DESCRIPTION OF THE DRAWINGS

The present invention can be further understood with reference to the following detailed description and the appended drawings, wherein like elements are provided with like reference numerals.

DETAILED DESCRIPTION

Embodiments of circuits for hair drying device are described in detail herein. In the following description, some specific details, such as example circuits for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with circuits and methods that are meant to be exemplary and illustrative. In various embodiments, the above problem has been reduced or eliminated, while other embodiments are directed to other improvements.

Figure 1:
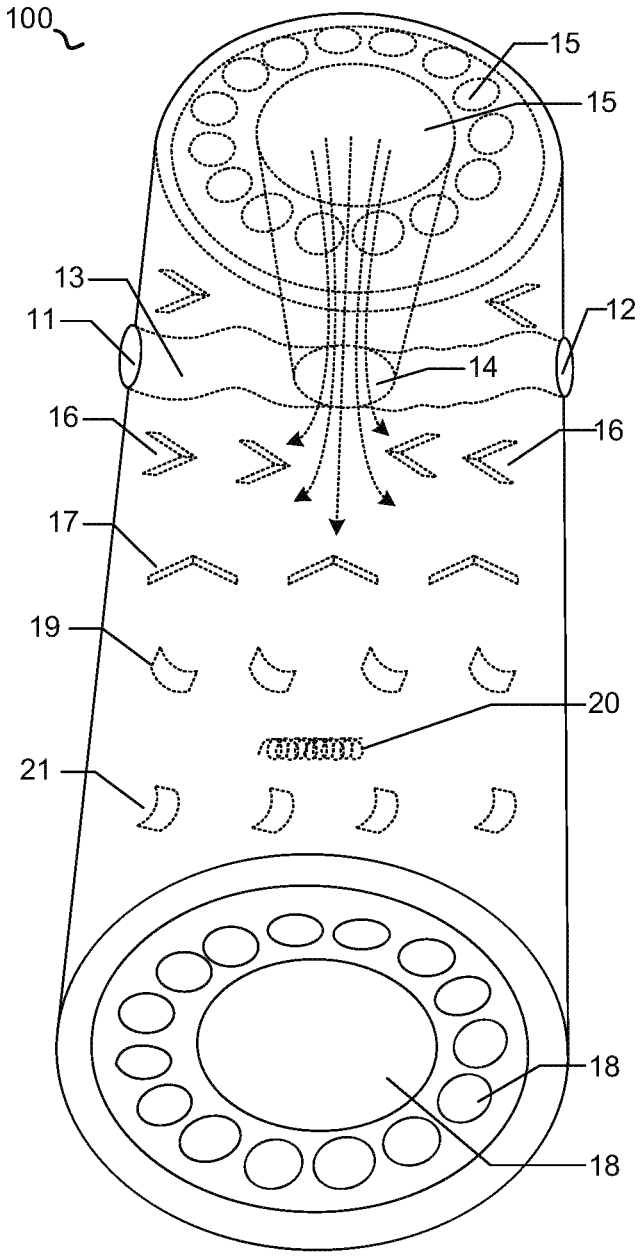
FIG. 1 is a schematic perspective view of a hair drying device 100 in accordance with an embodiment of the present invention.

FIG. 1 is a schematic perspective view of a hair drying device (may also be referred to as a hair drying appliance) 100 in accordance with an embodiment of the present invention. In the example of FIG. 1, the hair drying device 100 comprises: a left inlet opening 11, a right inlet opening 12, an internal inlet channel 13, an air supply inlet 14, and a back inlet opening 15. Upon activation of the hair drying device 100, plenty of air is drawn into an internal space of the hair drying device 100 through the left inlet opening 11, the right inlet opening 12, the internal inlet channel 13, the air supply inlet 14 and the back inlet opening 15. The air is then separated into multi airflows by way of a plurality of diverting blocks 16. The multi airflows are then respectively delivered to different parts of hairs, to dry the hairs. Thus, an evaporation efficiency is increased.

Figure 2:
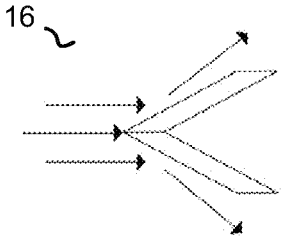
FIG. 2 schematically shows a diagram of the diverting block 16 in accordance with an embodiment of the present invention.

In one embodiment of the invention, the diverting blocks 16 are assembled near the internal inlet channel 13 at a backboard of the hair drying device 100, and shaped as an arrow, so as to change the unidirectional airflows to different directions, as shown in FIG. 2.

Figure 3:
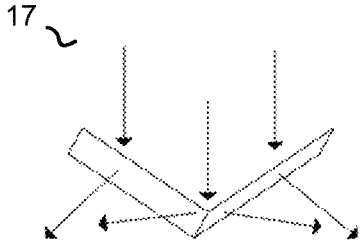
FIG. 3 schematically shows a diagram of the springback blocks 17 in accordance with an embodiment of the present invention.

In the example of FIG. 1, the hair drying device 100 further includes: a plurality of springback blocks 17, configured to change a direction of the airflows. For example, some of the airflows may change its direction from downward to upward. These upward airflows blow the hair from the root, which accelerates the hair drying. In one embodiment of the invention, the springback blocks 17 are assembled in front of the diverting blocks 16 toward an outlet opening 18 at the backboard of the hair drying device 100. The springback blocks 17 are shaped as an inverted arrow, which is also like a letter V, as shown in FIG. 3.

In the example of FIG. 1, the hair drying device 100 further includes: a plurality of right derivation blocks 19, configured to shift the direction of the airflows output from the springback blocks 17 to right; and a heat block 20, configured to heat and/or further heat the airflows. The heated airflows then blow the middle part of the hair, to further accelerate the hair drying. The heat block 20 may comprise heat elements such as heating wires.

In one embodiment of the invention, the hair drying device 100 further includes: a plurality of left derivation blocks 21, configured to shift the direction of airflows from right to straight (i.e. to correct the flow direction of the air); and a plurality of outlet openings 18, wherein the hair drying device 100 is configured to discharge the heated airflow (i.e. the airflows heated by the heat block 20) through the outlet openings 18.

Figure 4:
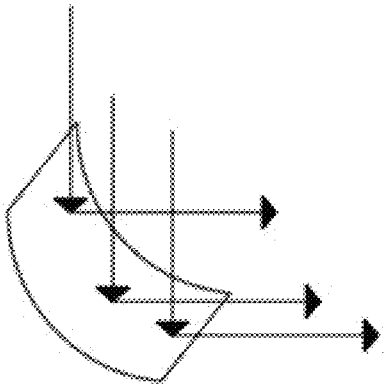
FIG. 4 schematically shows a diagram of the right derivation blocks 19, the left derivation blocks 22, or the collect block 20 in accordance with an embodiment of the present invention.

In one embodiment of the invention, the right derivation blocks 19 and the left derivation blocks 21 are shaped as curved blocks as shown in FIG. 4, which function to change the direction of the airflows blew therein. They are all assembled in front of the springback blocks 17 toward the outlet opening 18 at the backboard of the hair drying device 100.

Figure 5:
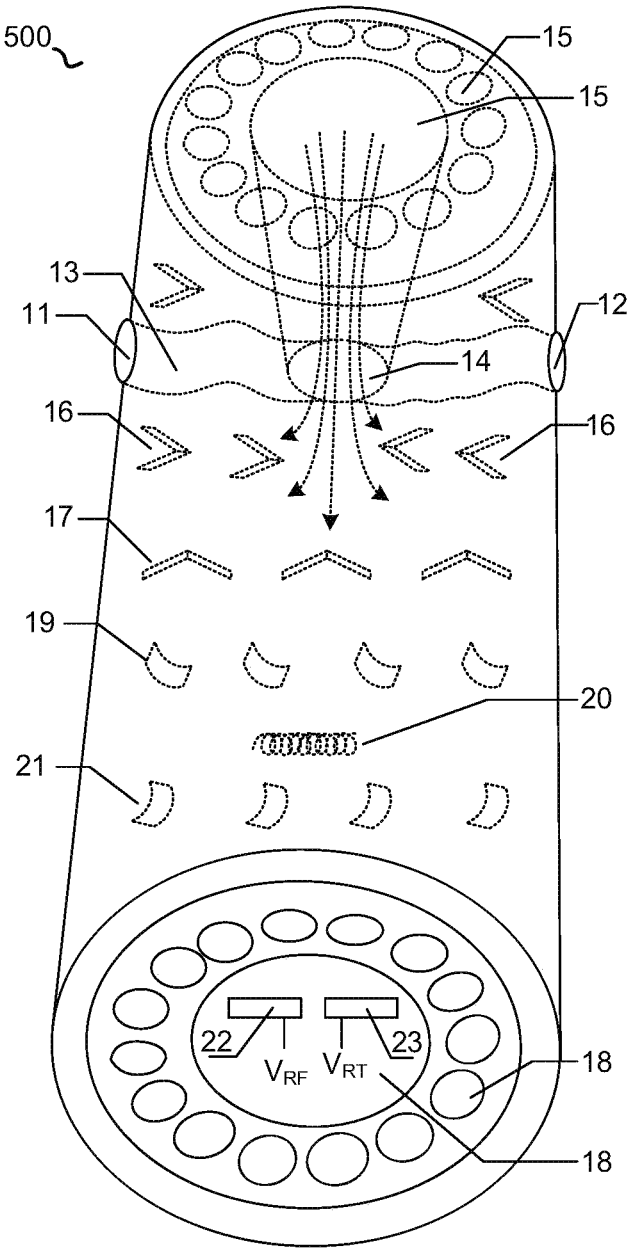
FIG. 5 is a schematic cross-sectional view of a hair drying device 500 in accordance with an embodiment of the present invention.

FIG. 5 is a schematic cross-sectional view of a hair drying device 500 in accordance with an embodiment of the present invention. The hair drying device 500 in the embodiment of FIG. 5 is similar to the hair drying device 100 in FIG. 1, with a difference that in the example of FIG. 5, the hair drying device 500 further comprises: a wind detector 22 and a power generation block 23, both assembled closed to the outlet opening 18 at the backboard of the hair drying device 100. The wind detector 22 is configured to detect a wind force ($V_F$) of the airflow, and to initiate a protect signal ($V_P$) if the wind force of the airflow is lower than a force reference ($V_{RF}$). The power generation block 23 is configured to detect a temperature difference between the airflows internal and external of the hair drying device, and to shut down the hair drying device if the temperature difference is higher than a temperature reference $V_{RT}$.

Figure 6:
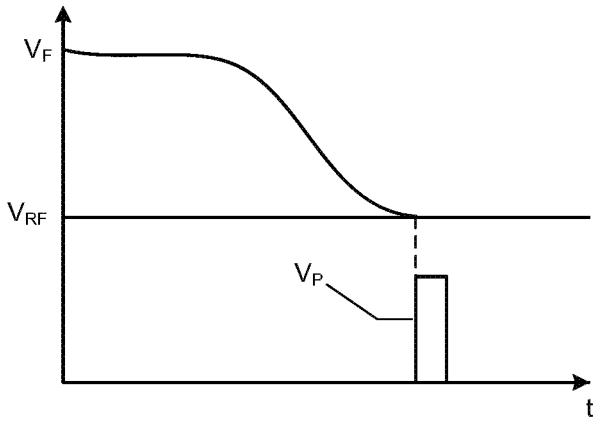
FIG. 6 schematically shows the timing waveforms of the wind force ($V_F$) of the heated airflow, the threshold $V_{TH}$ and the protect signal $V_P$ in accordance with an embodiment of the present invention.

When the hair drying device is on operation, the wind detector 22 detects the wind force of the airflow closed to the outlet opening. If the wind force is high (e.g., much higher than the force reference $V_{RF}$), it indicates the airflows are smooth internal the hair drying device. On the contrary, if the wind force is low, e.g., lower than the force reference $V_{RF}$, it indicates that an air blockage is happened inside the hair drying device. Accordingly, a protect signal will be initiated, to protect the device, as shown in FIG. 6.

Figure 7:
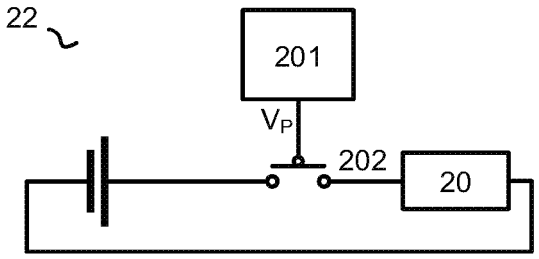
FIG. 7 schematically shows a circuit configuration of the wind detector 22 in accordance with an embodiment of the present invention.

FIG. 7 schematically shows a circuit configuration of the wind detector 22 in accordance with an embodiment of the present invention. As shown in FIG. 7, the wind detector 22 comprises: a force monitoring block 201 and a trigger switch 202. The force monitoring block 201 is configured to detect the wind force of the airflows. If the wind force is high, e.g., higher than the force reference $V_{RF}$, the trigger switch 202 is turned on, to activate the heat block 20 to initiate heating and/or further heating the airflows.

Figure 8:
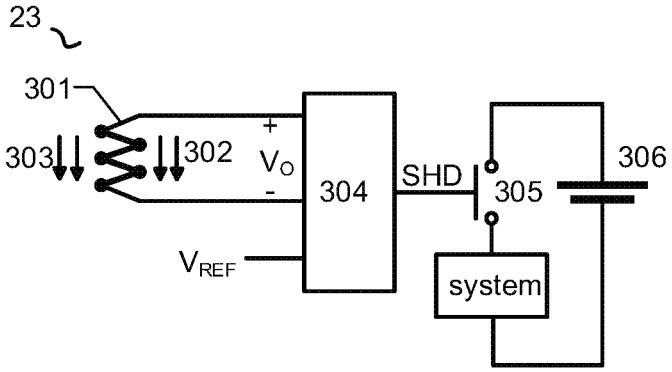
FIG. 8 schematically shows a circuit configuration of the power generation block 23 in accordance with an embodiment of the present invention.

FIG. 8 schematically shows a circuit configuration of the power generation block 23 in accordance with an embodiment of the present invention. As shown in FIG. 8, the power generation block 23 comprises: a power slice 301, configured to generate an output voltage $V_O$ in response to the temperature difference between the airflows internal (302) and external (303) of the hair drying device; and a temperature monitor 304, configured to compare the output voltage $V_O$ with a voltage reference $V_{REF}$, to detect the temperature difference. If the output voltage $V_O$ goes higher than the voltage reference $V_{REF}$, indicating the airflows internal the hair drying device have a high temperature, the hair may get hurt. Then, the temperature monitor 304 would output a shutdown signal SHD to shut down the hair drying device, to prevent the hair from overheating.

In one embodiment of the present invention, the hair drying device may be shut down by being disconnected from a power source. As shown in FIG. 8, the power generation block 23 further comprises: a shutdown switch 305, configured to be turned off in response to the shutdown signal SHD to disconnect the hair drying device (e.g. the system of the hair drying device) from the power source 306.

In one embodiment of the present invention, the power slice 301 is mounted close to the outlet opening 18.

In one embodiment of the present invention, the wind detector 22 and the power generation block 23 may be powered by the output voltage $V_O$. Thus, the wind detector 22 and the power generation block 23 can work independently from the system, which provides better protection to the system.

Figure 9:
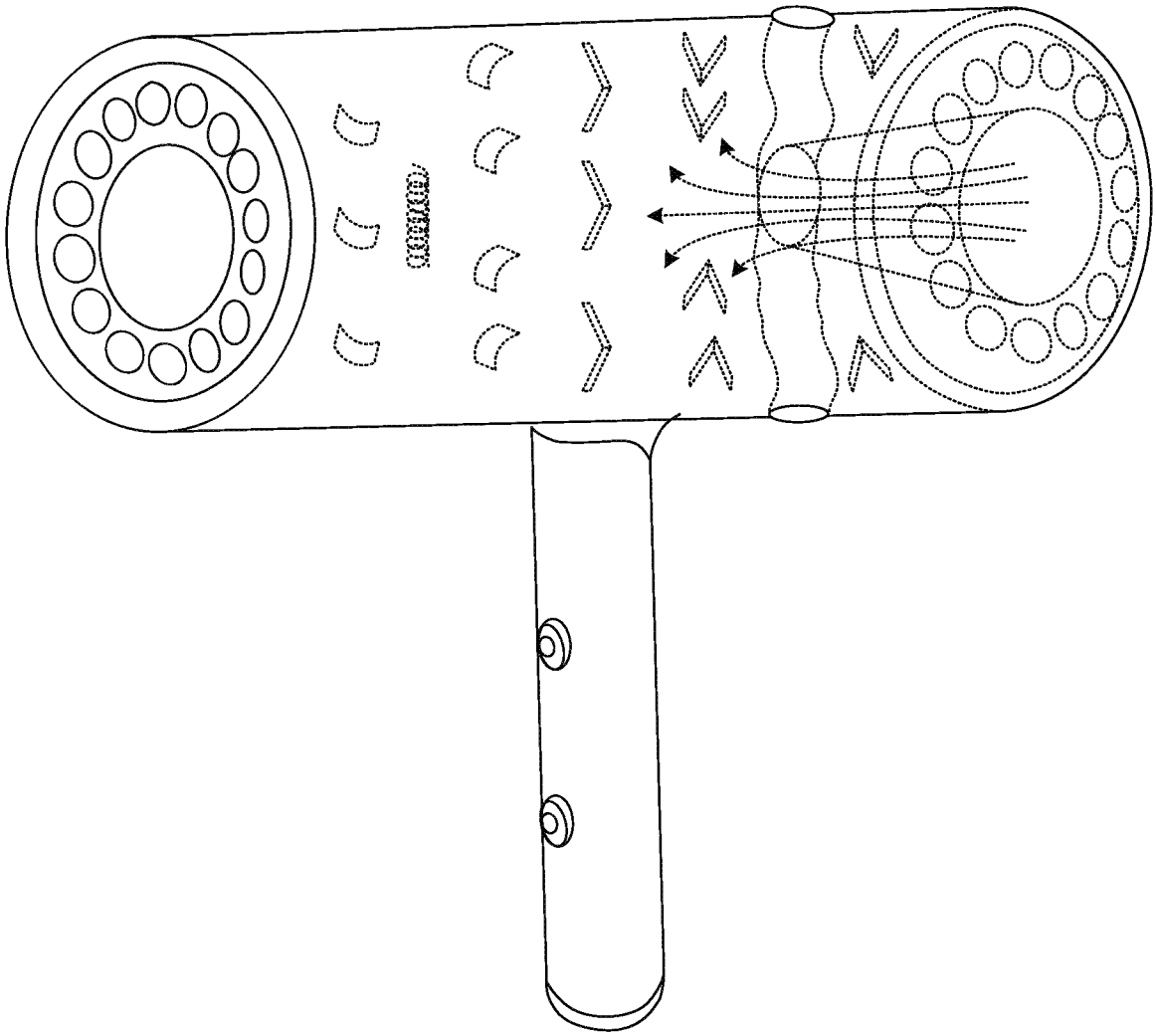
FIG. 9 is a schematic perspective view of a hair drying device incorporated in a hairdryer in accordance with an embodiment of the present invention.

In one embodiment of the present invention, the hair drying device may be incorporated in a hairdryer, i.e., the hair drying device may be assembled as a part of the hairdryer, as shown in FIG. 9. The hairdryer may further comprise a motor (not shown) to drive a fan (not shown), so as to draw air into the inlet opening of the hair drying device. The airflows are then distributed and heated by the hair drying device, to accelerates the hair drying.

Figure 10:
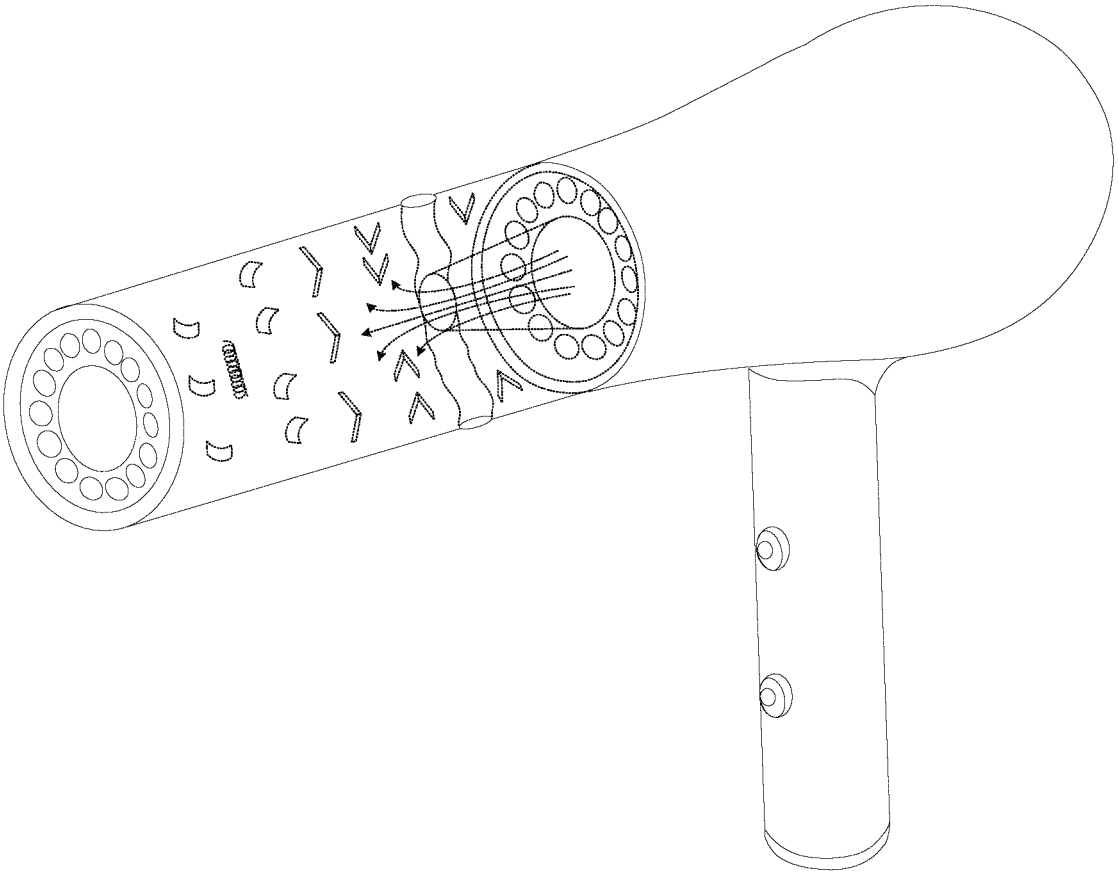
FIG. 10 is a schematic perspective view of a hair drying device externally coupled to a hairdryer in accordance with an embodiment of the present invention.

In an alternative embodiment of the present invention, the hair drying device may be externally coupled to a hairdryer, as shown in FIG. 10. Airflows emitted through an outlet opening of the hairdryer are input to the inlet opening of the hair drying device. Then the airflows are distributed and heated by the hair drying device, to accelerates the hair drying.

Obviously many modifications and variations of the present invention are possible in light of the above teachings. It is therefore to be understood that within the scope of the appended claims the invention may be practiced otherwise than as specifically described. It should be understood, of course, the foregoing disclosure relates only to a preferred embodiment (or embodiments) of the invention and that numerous modifications may be made therein without departing from the spirit and the scope of the invention as set forth in the appended claims. Various modifications are contemplated and they obviously will be resorted to by those skilled in the art without departing from the spirit and the scope of the invention as hereinafter defined by the appended claims as only a preferred embodiment(s) thereof has been disclosed.

The invention claimed is:

1. A hair drying device, comprising:

a left inlet opening, a right inlet opening, an internal inlet channel, an air supply inlet and a back inlet opening, configured to draw airflows into an internal space of the hair drying device;

a heat block, configured to heat the airflows;

an outlet opening, configured to discharge the airflows heated by the heat block;

a wind detector, configured to detect a wind force of the airflows, and to initiate a protect signal if the wind force of the airflows is lower than a force reference; and a power generation block, configured to detect a temperature difference between the airflows internal and external of the hair drying device, and to shut down the hair drying device if the temperature difference is higher than a temperature reference.

2. The hair drying device of claim 1, further comprising:

a plurality of diverting blocks, configured to deliver the airflows to different parts of hairs; and a plurality of springback blocks, configured to change a direction of the airflows.

3. The hair drying device of claim 2, further comprising:

a plurality of right derivation blocks, configured to shift the direction of the airflows output from the springback blocks to right; and a plurality of left derivation blocks, configured to shift the direction of airflows from right to straight.

4. The hair drying device of claim 1, wherein the wind detector comprises:

a force monitoring block, configured to detect the wind force of the airflows; and a trigger switch, configured to be turned on if the wind force is higher than the force reference, to activate the heat block to initiate heating the airflows.

5. The hair drying device of claim 1, wherein the power generation block comprises:

a power slice, configured to generate an output voltage in response to the temperature difference between the airflows internal and external of the hair drying device; and a temperature monitor, configured to compare the output voltage with a voltage reference, to detect the temperature difference; wherein if the output voltage goes higher than the voltage reference, the temperature monitor outputs a shutdown signal to shut down the hair drying device.

6. The hair drying device of claim 5, wherein:

the wind detector and the power generation block are both powered by the output voltage.

7. The hair drying device of claim 1, wherein the hair drying device is shut down by being disconnected from a power source.

8. A hair drying device, comprising:

a left inlet opening;

a right inlet opening;

an internal inlet channel;

an air supply inlet;

a back inlet opening; wherein airflows are drawn into an internal space of the hair drying device through the left inlet opening, the right inlet opening, the internal inlet channel, the air supply inlet and the back inlet opening;

an outlet opening, configured to discharge the airflows; and a wind detector, configured to detect a wind force of the airflows and to initiate a protect signal if the wind force of the airflow is lower than a force reference.

9. The hair drying device of claim 8, further comprising:

a plurality of diverting blocks, configured to deliver the airflows to different parts of hairs; and a plurality of springback blocks, configured to change a direction of the airflows.

10. The hair drying device of claim 9, further comprising:

a plurality of right derivation blocks, configured to shift the direction of the airflows output from the springback blocks to right; and a plurality of left derivation blocks, configured to shift the direction of airflows from right to straight.

11. The hair drying device of claim 8, wherein the wind detector comprises:

a force monitoring block, configured to detect the wind force of the airflows; and a trigger switch, configured to be turned on if the wind force is higher than the force reference, to activate a heat block to initiate heating the airflows.

12. The hair drying device of claim 8, further comprising:

a heat block, configured to heat the airflows; and a power generation block, configured to detect a temperature difference between the airflows internal and external of the hair drying device, and to shut down the hair drying device if the temperature difference is higher than a temperature reference.

13. The hair drying device of claim 12, wherein the power generation block comprises:

a power slice, configured to generate an output voltage in response to the temperature difference between the airflows internal and external of the hair drying device; and a temperature monitor, configured to compare the output voltage with a voltage reference, to detect the temperature difference; wherein if the output voltage goes higher than the voltage reference, the temperature monitor outputs a shutdown signal to shut down the hair drying device.

14. The hair drying device of claim 13, wherein:

the wind detector and the power generation block are both powered by the output voltage.

15. A hair drying device, comprising:

a left inlet opening, a right inlet opening, an internal inlet channel, an air supply inlet and a back inlet opening, configured to draw airflows into an internal space of the hair drying device;

a heat block, configured to heat the airflows;

an outlet opening, configured to discharge the airflows heated by the heat block; and a power generation block, configured to detect a temperature difference between the airflows internal and external of the hair drying device, and to shut down the hair drying device if the temperature difference is higher than a temperature reference.

16. The hair drying device of claim 15, wherein the power generation block comprises:

a power slice, configured to generate an output voltage in response to the temperature difference between the airflows internal and external of the hair drying device; and a temperature monitor, configured to compare the output voltage with a voltage reference, to detect the temperature difference; wherein if the output voltage goes higher than the voltage reference, the temperature monitor outputs a shutdown signal to shut down the hair drying device.

17. The hair drying device of claim 15, further comprising:

a wind detector, configured to detect a wind force of the airflows and to initiate a protect signal if the wind force of the airflow is lower than a force reference.

18. The hair drying device of claim 17, wherein the wind detector comprises:

a force monitoring block, configured to detect the wind force of the airflows; and a trigger switch, configured to be turned on if the wind force is higher than the force reference, to activate the heat block to initiate heating the airflows.

19. The hair drying device of claim 15, further comprising:

a plurality of diverting blocks, configured to deliver the airflows to different parts of hairs; and a plurality of springback blocks, configured to change a direction of the airflows.

20. The hair drying device of claim 15, further comprising:

a plurality of right derivation blocks, configured to shift the direction of the airflows output from the springback blocks to right; and a plurality of left derivation blocks, configured to shift the direction of airflows from right to straight.

* * * * *